United States Patent [19]

Eliasson

[11] 4,086,015

[45] Apr. 25, 1978

[54] CRASH MODERATION SYSTEM FOR ROADS, HIGHWAYS, RAILWAYS, AIRFIELDS AND HARBORS

[76] Inventor: Sonja Margareta Isabella Eliasson, Roskildevagen 17 A, S-217 46 Malmo, Sweden

[21] Appl. No.: 727,163

[22] Filed: Sep. 27, 1976

[51] Int. Cl.[2] ..... E01F 13/00

[52] U.S. Cl. ..... 404/6

[58] Field of Search ..... 404/6, 9, 7; 256/13.1, 256/1

[56] References Cited

U.S. PATENT DOCUMENTS

| | | | |
|---|---|---|---|
| 3,288,440 | 11/1966 | Schimmelpenninck | 404/6 X |
| 3,494,607 | 2/1970 | Rusch | 256/1 X |
| 3,876,185 | 4/1975 | Welch | 404/6 X |
| 3,880,404 | 4/1975 | Fitch | 404/6 X |

*Primary Examiner*—Nile C. Byers

*Attorney, Agent, or Firm*—Berman, Aisenberg & Platt

[57] ABSTRACT

A lightweight, strong, not easily destructible material, in the form of pellets such as lightweight aggregate of burnt expanded clay, shale or slate, foamed glass, cinder or granulated plastic, with a density of up to about 40 lbs per cubic ft., is being placed on the ground where the impact reduction is desired. The dimensions and the amount of the material are related to the type, weight and speed of the object that can make the impact. The pellets of the lightweight material are not bound or connected to each other except for the surface of the wall, which is bound together by cement, plastic, nets or plastic liners applied in situ or prior to the installation for example with gabions (net boxes). The sloping of the wall of the lightweight material is vertical or at least more steep than the natural angle of repose for the lightweight material.

10 Claims, 5 Drawing Figures

CRASH MODERATION SYSTEM FOR ROADS, HIGHWAYS, RAILWAYS, AIRFIELDS AND HARBORS

The purpose of the present invention is to simplify and reduce the cost of building safety arrangements, especially for traffic-handling construction such as roads, railways, runways of airports and whenever large heavy objects may, by some reason or another, vigorously depart from there intended direction with a resulting accident, particularly by making possible a practical arrangement at walls beside the road by a special material. For this main purpose and such further purposes which will appear from the following detailed description in connection with the accompanying illustrations, the invention concerns a special safety device. The significant patterns of this device appear from the claims.

The volume of traffic for both goods and persons is growing very fast. The hazards in traffic also increase and the cost for individuals and communities is high. The number of accidents where vehicles drive off the roadway or where cars on freeways drive a median and onto a roadway of oncoming vehicles, is very large. In order to prevent such accidents, barriers, such as steel guard rails, have been erected. These involve considerable cost. Such barriers however, often have insufficient capacity to absorb the kinetic energy of the vehicle, which can bounce back on the roadway and cause an even worse accident.

For several years the use of materials for erecting embankments at roadsides or medians of the roads has been experimented with. Ordinary earth walls have been used, for example at many car-racing tracks, with bad results. Further, the use of special lightweight materials to erect walls or barriers, when the material is placed in bulk, is well known. Such materials have the outstanding effect that a vehicle will brake softly when heading into such barrier. Moreover, the bounce effect is reduced to a minimum. One such light-weight material is called lightweight aggregate, i.e. pellets of a size from 0 to about 1¼ inches in diameter, consisting of expanded (blown up), burnt clay, shale, slate or similar material with a density of up to about 40 pounds per cubic foot. Also other similar materials, e.g. broken natural lave in granular form, can be used with excellent results. All these materials provide this desired effect but have several disadvantages which technology has not been able to overcome in an economical way. For example, too much unnecessary material has to be used since the material has such a flat angle to a repose e.g. about 30°–35° . The material of the walls has always been laid out in bulk at a natural angle of repose, which requires much space, for example at center strips on freeways. A more serious deficiency is the risk that the material may, when heavy winds are blowing, blow away and that people and animals passing the barrier may sink deeply into it and spread the material unintentionally over larger areas than desired. To eliminate these negative properties of the material, sand or gravel have been mixed among the lightweight friction material, but then the positive crash-moderation are promptly reduced.

The present invention solves all these problems in a surprising way. It makes it possible to neglect the neeed for a barrier Moreover, weather conditions cannot ruin the arrangement. In the winter the general principle of the material works extremely well, as only the surface freezes and gets hard, but not too hard, as the material itself has good heat-insulation properties.

The surface layer of the material is bound in a special way to provide a hard and brittle sheel around the material. This shall, however, can be broken through e.g. when a car hits the barrier with a great force. By such bending, the slopes of the barrier are made steeper than the natural angle of repose of 30°–35°. The material can be walked or without moving or spreading around.

The drawings show some ways of carrying out the invention. FIG. 1 is a vertical section of a freeway, showing material 1 which is appropriately bound on the surface 2. The material is laid out both on the center strip and on the sides of each roadway.

Figure 1:
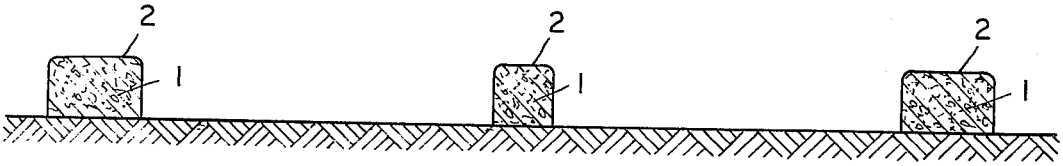
Figure 2:
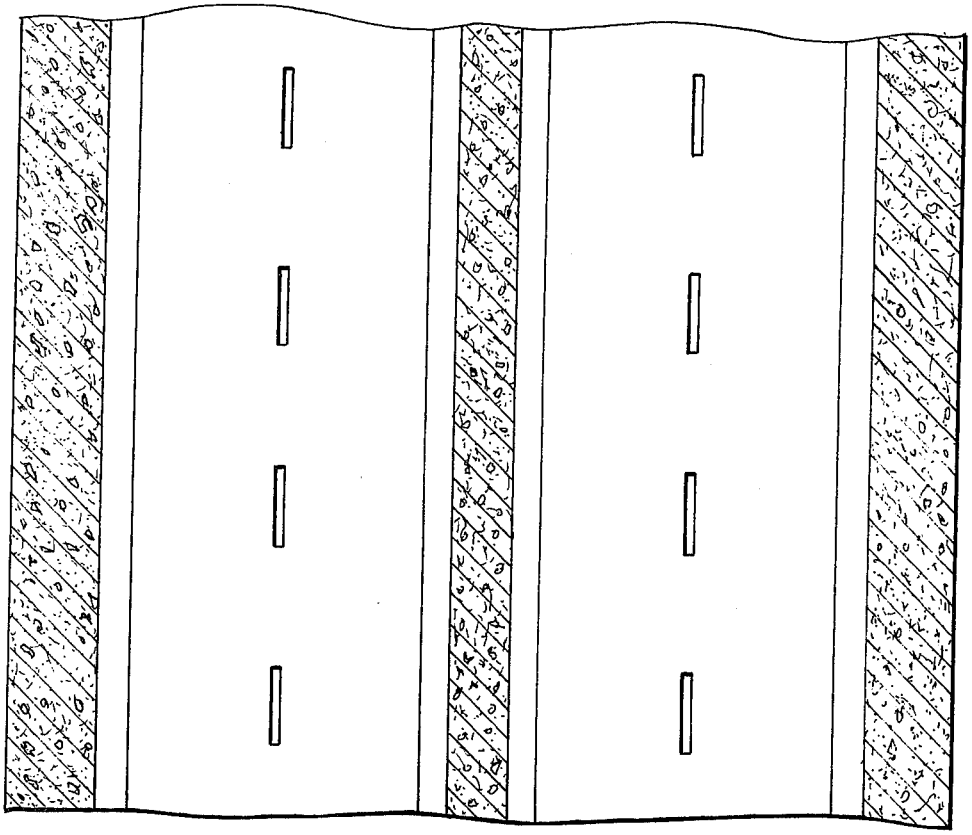
FIG. 2 shows the plan view of the same freeway as in FIG. 1.
Figure 3:
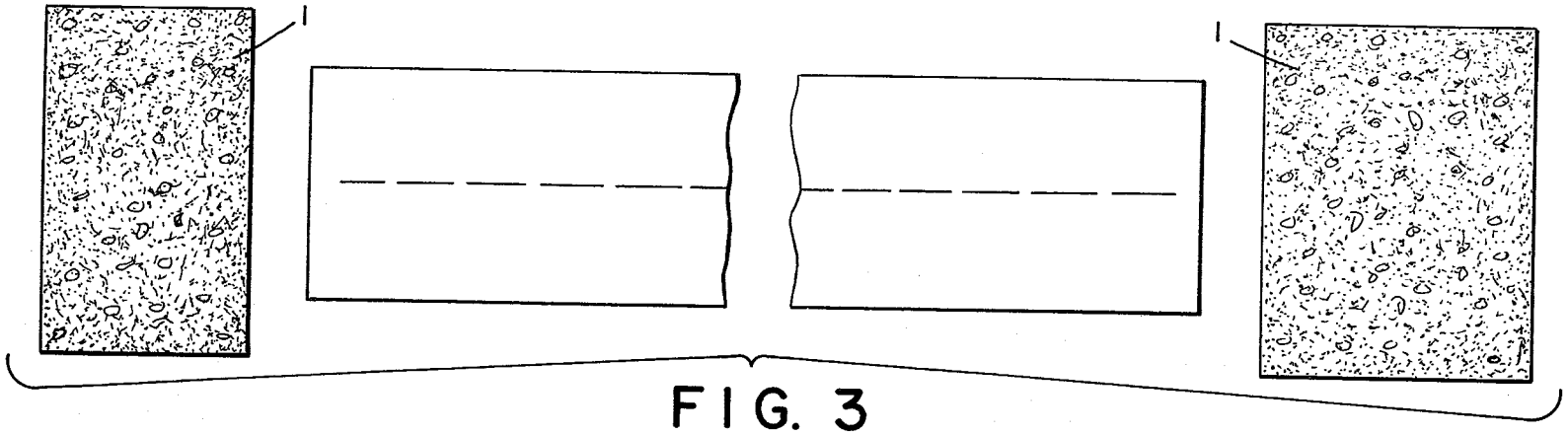
FIG. 3 shows a plan view of a take-off and landing-strip of an airport. Material is laid out at both ends of the runway.
Figure 4:
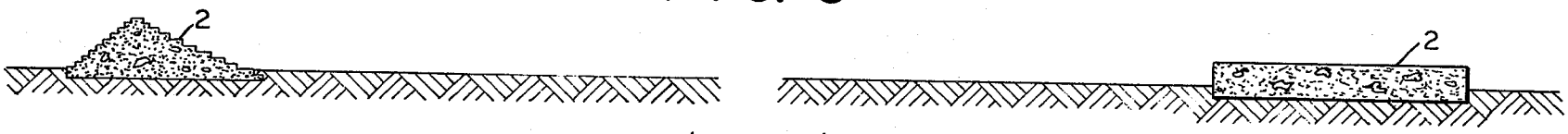

FIG. 4 shows a vertical section of the same take-off and landing-strip as in FIG. 3. Examples of the thickness of the layer of the material are shown. As an example of the invention material 1 is placed in prefabricated net boxes (gabions) 2, which can be of various sizes.

Figure 5:
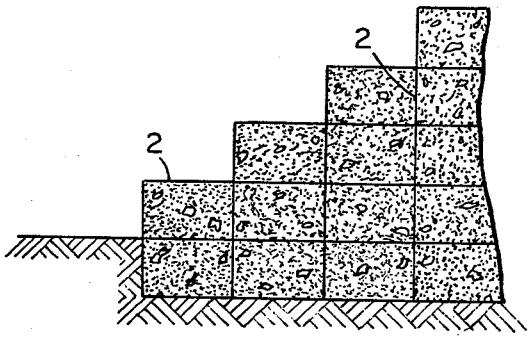

FIG. 5 shows a part of FIG. 4, in a larger scale. The example shows big boxes. Generally they are smaller in practice.

The above-mentioned binding can be carried out in different ways. The surface can be treated with a binding medium, such as a plastic layer that is brittle, or a mixture of cement, (possibly sand,) and water, which is sprayed onto the material. However, it is important that this spray does not penetrate more than some (1–2) inches, so that the shell does not get too strong. The compressive strength can be 10–40 lbs. per sq.inch. In my invention too much of the layer must not be bound but only a thin surface layer. The barriers or blocks can be made by holding the material together with a simple net while spraying the material and awaiting the hardening of the binding medium. The net can then be removed and reused. Another way of obtaining the desired effect without cement-binding is to use a permanent net with a mesh so that the lightweight pellets cannot pass therethrough. Such a net must be able to give way so that a vehicle will be stopped by the lightweight material and not by the net. Thus, very inexpensive types of nets can be used. The lightweight material can be used in desired sizes, and the net fitted thereto or the reverse. The net is not here understood as a reinforcement net or mat of steel or similar material. If desired, a thin layer of earth can be applied outside the binder on which e.g., grass can grow Contrary to this invention barrier material according to this invention the lightweight material can be in gabions, i.e. that the material is locked in net boxes, which can be placed one over and/or beside the other for quick erection of a crash barrier. The gabions, including the lightweight material, can be prefabricated. Instead of nets, plastic liners can be used. The use of gabions is one of the most practical embodiments of this invention. The invention is useful for ordinary roads, freeways and, for example, at car-racing tracks. The same arrangements can generaly be used at airport runways and at the extension of the take-off and landing-strips, where very costly arrangements and now used for catching up the airplanes to protect them from sliding off the runway. Usually these arrangements are so costly and complicated that no arrangements at all are erected. With a special material bound as indicated, such problems are solved in a quite revolutionary simple and inexpensive way. The invention can also be used in harbours for both large and small ships.

What I claim and desire to secure by letters Patent is:

1. A crash moderation system for placement on a supporting surface and comprising a barrier which includes:

(a) strong, kinetic-energy-absorbing, lightweight, pellet-form material with a maximum density of approximately 40 pounds per cubic foot and pellets ranging from 0 to 1.25 inches in diameter, and (b) material-surrounding binding means to contain the pellets, to sustain their kinetic-energy absorbing effect and to provide the barrier with a surface that makes an angle with the supporting surface which is steeper than the angle of repose for the lightweight material.

2. A crash moderation system according to claim 1 wherein the lightweight material is comprised of burnt expanded clay, slate or shale.

3. A crash moderation system according to claim 1 wherein the lightweight material is comprised of foamed glass.

4. A crash moderation system according to claim 1 wherein the lightweight material is comprised of cinder.

5. A crash moderation system according to claim 1 wherein the lightweight material is comprised of granulated plastic.

6. A crash moderation system according to claim 1 wherein the pellet-form material binding means is a prefabricated net gabion having a sufficiently fine mesh to contain the pellets, and the barrier comprises a plurality of such prefabricated net gabions.

7. A crash moderation system according to claim 1 wherein the pellet-form material is a prefabricated plastic box-form liner, and the barrier is constituted by a plurality of such light-weight-material-filled liners.

8. A crash moderation system according to claim 1 wherein the pellet-form material binding means is an elastic net having a sufficiently fine mesh to retain the lightweight material, the elastic net forming the barrier surface.

9. A process for making a crash moderation system according to claim 1 which comprises securing the lightweight material in the form of a barrier by holding the pellets in place with a net, spray-coating pellets on the outside of the thus-formed barrier with a plastic material, allowing the plastic coating to harden sufficiently to support the barrier, and removing the net.

10. A process for preparing a crash moderation system according to claim 1 which comprises securing the lightweight material in barrier form with a net having a sufficiently fine mesh to contain the pellets, spraycoating surface pellets with a mixture of cement and water, allowing the cement to harden sufficiently to support the barrier, and removing the net.

* * * * *